US006827138B1

(12) United States Patent
Master et al.

(10) Patent No.: US 6,827,138 B1
(45) Date of Patent: Dec. 7, 2004

(54) HEAT EXCHANGER

(75) Inventors: Bashir I. Master, Wayne, NJ (US); Krishnan S. Chunangad, West Paterson, NJ (US); Venkateswaran Pushpanathan, West Paterson, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 10/644,157

(22) Filed: Aug. 20, 2003

(51) Int. Cl.[7] ..... F28F 9/22
(52) U.S. Cl. ..... 165/159; 165/162
(58) Field of Search ..... 165/158–161

(56) References Cited

U.S. PATENT DOCUMENTS 948,835 A * 2/1910 Walter ..... 165/160
1,522,866 A * 1/1925 Colston ..... 165/161
1,525,094 A * 2/1925 Jones ..... 165/161
1,782,409 A * 11/1930 Chute ..... 165/161
2,384,714 A * 9/1945 Villiger ..... 165/161
2,693,942 A * 11/1954 Guala ..... 165/161
3,400,758 A * 9/1968 Man ..... 165/159
4,360,059 A * 11/1982 Funke ..... 165/160
4,493,368 A * 1/1985 Gronnerud et al. ..... 165/159
4,697,321 A * 10/1987 Shibuya et al. ..... 29/890.03
5,327,957 A * 7/1994 Killebrew ..... 165/161
5,832,991 A * 11/1998 Cesaroni ..... 165/160

FOREIGN PATENT DOCUMENTS

GB 1601667 A * 11/1981 ..... F28F/9/22

* cited by examiner

*Primary Examiner*—Allen J. Flanigan
(74) *Attorney, Agent, or Firm*—Dilworth & Barrese, LLP

(57) ABSTRACT

A heat exchanger is configured to have quadrant shaped baffles positioned at an angle to a longitudinal axis of shell for guiding cross-flow of fluid into a helical pattern while maintaining substantially uniform velocity of the cross-flow.

18 Claims, 4 Drawing Sheets

HEAT EXCHANGER

SUMMARY OF THE INVENTION

1. Field of the Invention

This invention relates to a heat exchanger and more particularly, but not exclusively, to a shell and tube heat exchanger configured to provide for a uniform velocity of fluid flow along a helical path and a maximized heat transfer.

2. Summary of the Invention

A constant battle for maximizing production by heat-exchanging and/or heat-generating assemblies primarily target to achieve the following:

Higher heat transfer efficiency;

Lower pressure drop;

Increased performance;

Effective protection against vibration; and

Reduced installation and maintenance costs.

Whether it is the offshore, refinery, power, petrochemical or paper and food industries, heat exchangers are often the core of the above-enumerated objectives. Numerous configurations of the heat exchanger are known and used for a variety of applications. One of the widely used configurations of the heat exchanger-a shell and tube heat exchanger of FIG. 1-comprises a cylindrical shell 10 housing a bundle of parallel pipes 12, which extend between two end plates 14 so that a first fluid 16 can pass through the pipes 12. Meanwhile, a second fluid 18 flows in and through the space between the two end plates so as to come into contact with the pipes. To provide an improved heat exchange between the two fluids, the flow of the second fluid 18 is defined by intermediate baffles 20 forming respective passages, which are arranged so that the second fluid flow changes its direction in passing from one passage to the next. The baffles 20, configured as annular rings and discs, are installed perpendicular to a longitudinal axis 22 of the shell 10 to provide a zigzag flow 24 of the second fluid 18.

Disadvantageously, the second fluid has to sharply change the direction of its flow several times along the length of the shell. This causes a reduction in the dynamic pressure of the second fluid and non-uniform flow velocity thereof, which, in combination, adversely affect the performance of the heat exchanger.

A scientific community has long been aware that a perpendicular position of baffles relative to the longitudinal axis of the shell is largely responsible for a relatively inefficient heat transfer rate/pressure drop ratio. Adjacent baffles extending parallel to one another and at a right angle with respect to the longitudinal axis of the shell define a cross flow path characterized by numerous sharp turns between adjacent channels. The efficiency of heat transfer can be improved by reducing the spacing or window between the baffles. However, decreasing the window results in high flow velocity along the outer edges of the baffles, which are juxtaposed with the shell, and low flow velocity closer to the center of the shell. The non-uniformity of flow distribution within each segment defined between the adjacent baffles causes numerous eddies, stagnation regions as well expansion/contraction of pipe stretches, which decrease convective heat transfer rates. A further factor contributing to a decreased heat transfer rate is attributed to the fact that the pipes traversed by the first fluid have to be positioned at a certain radial distance from the shell. Accordingly, the cross flow around the peripherally located pipes is faster than around centrally mounted pipes.

Thus, conventional baffle arrangement as described above results in flow bypass through baffle-to-shell and pipe-to-baffles clearances. Bypass flow reduces the cross-flow heat transfer while the flow maldistribution caused by significant velocity variations increases back-flow and eddies in the dead zones, and consequently higher rates of fouling on the shellside. Such flow maldistribution leads to the high temperatures and corrosion of the peripheral pipes causing their rapid deterioration and, as a consequence, the reduced role in the heat exchange process. Since the heat exchanger design is based on the uniform contribution of each pipe of the entire bundle to the heat exchange process, those pipes that have been damaged cannot meet this requirement and should be replaced. Costs associated with such replacement are high making the maintenance of the heat exchanger cost prohibitive.

Furthermore, conventional arrangement may cause high flow-induced vibration losses since long pipes reaching often 24-feet long are supported by a succession of baffles which, in order to solve the problem associated with the non-uniform velocity, are spaced apart at a substantial distance. As a result of high thermal gradient and non-uniform cross flow vibration hazards are significant.

Thus, it is desirable to configure a baffle assembly that can attain the following objectives:

Uniformity of cross-flow through a shell leading to an improved convection heat exchange rate;

Stability and correctness of actual positioning of multiple baffles relative to multiple pipes supported by a baffle assembly or cage; and Facilitation of installment of a baffle assembly.

SUMMARY OF THE INVENTION

These objectives have been achieved by replacing conventional segmental plate baffles with a succession of spaced apart quadrant-shaped baffles each positioned at an angle to a longitudinal axis of a shell to create a pseudo helical flow path on the shellside. One of the advantages of the inventive structure is that the angularly positioned baffles act as guide vanes for the cross flow, which has substantially uniform velocity along the opposite sides of each baffle avoiding thus back flow and eddies.

Thus, instead of squeezing the cross flow as done in the above-discussed conventional design, a succession of inclined baffles directs the second fluid along a helical, more natural flow path providing for a substantially uniform flow rate and minimization of leakages. Since the flow velocity is substantially uniform on both sides of each baffle, a pressure gradient across the latter is insignificant. Hence, there are no undesirable leakages across or through the baffles, and the flow, as theoretically designed, occurs mainly along the surface of the baffles, which face the inner wall of the shell and form the peaks of the helical path. Thus, while the second fluid can traverse the entire length of the shell faster or slower depending on the angle of the baffles relative to the normal to the longitudinal axis of the shell, the flow velocity remains constant.

Furthermore, since flow energy consumed in expansion and contraction of flow conveying elements is minimal, the pressure losses are merely a fraction of the losses observed in the conventionally baffled heat exchangers. Thus, the helical baffle geometry offers much higher conversion of available pressure drop to heat transfer.

In accordance with one aspect of the invention, helical baffle quadrants reflect the segments of elliptical plates. Configuration of the elliptically shaped outer surfaces juxtaposed with the inner wall of the shell provides for tight clearances therebetween and, as a consequence, minimizes leakages when the helically baffled tube bundle is inserted into the shell.

To ensure the desired positioning of multiple baffles relative to one another and to a bundle of pipes subsequently mounted through these baffles, the invention provides for variously configured reinforcing elements interconnecting a succession of baffles. In accordance with one embodiment, separate longitudinal seal strips are tack welded to the baffle edges of adjacent baffles. Alternatively, spacer strips can bridge tie rods, which are configured to secure the spaced-apart baffles. Finally, the opposite radial flanks of each baffle may have an angularly extending flange provided with fully formed holes that are traversed by those pipes that would otherwise be secured in open semi holes formed along opposing edges of the adjacent baffles.

Still a further aspect of the invention provides for a helical baffle arrangement including two strings of baffles, which form a double helix pattern. Such a structure is particularly advantageous for reinforcing longs spans of pipes, without, however, affecting the uniform velocity of the flow.

The inventive structure is equally advantageous for existing plants as well as for grassroots applications. For the former, the advantage of the inventive structure is that it helps to increase the capacity while lowering maintenance costs. Indeed, the percentage of pipes needed to be replaced due to the corrosion and mechanical failure is substantially reduced as a result of elimination of eddies or back mixing. For the grassroots applications, the inventive structure helps to reduce plot space, energy costs and investment.

It is therefore an object of the invention to provide an improved baffle arrangement in a shell and pipe heat exchanger configured to minimize the non-uniformity of the cross flow velocity and to maximize the heat exchange rate;

Still a further object of the invention is to provide a quadrant baffle plate shaped to minimize clearances between the baffle arrangement the inner side of the shell;

Yet another object of the invention is to provide a succession of quadrant baffles with reinforcing arrangements configured to facilitate insertion and ensure the desired position of the pipes in the quadrant baffles;

A further object of the invention is to provide a double helix arrangement of the quadrant baffles configured to enhance bundle integrity against flow-induced vibrations; and Still a further object of the invention is to configure the quadrant baffles so that the double helix arrangement installation would be labor effective.

BRIEF DESCRIPTION OF THE DRAWINGS

The above and other objects, features and advantages will become more readily apparent from the following description accompanied by a set of drawings, in which.

DETAILED DESCRIPTION OF THE PREFERRED EMBODIMENT

Figure 2:
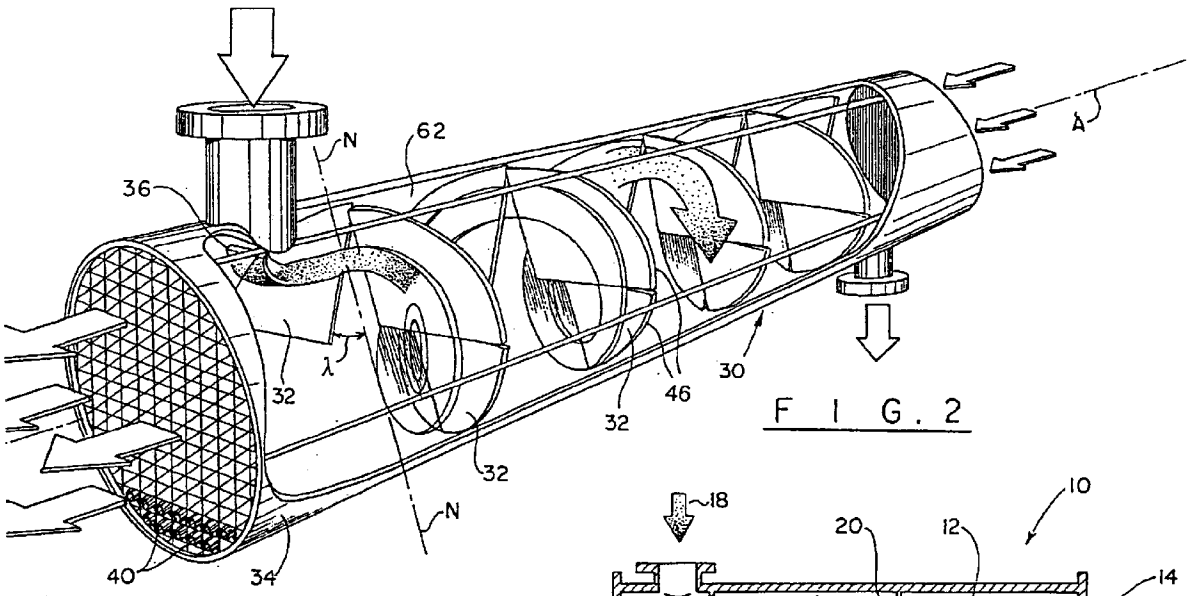
FIG. 2 is a diagrammatic perspective view of the inventive heat exchanger.
Figure 1:
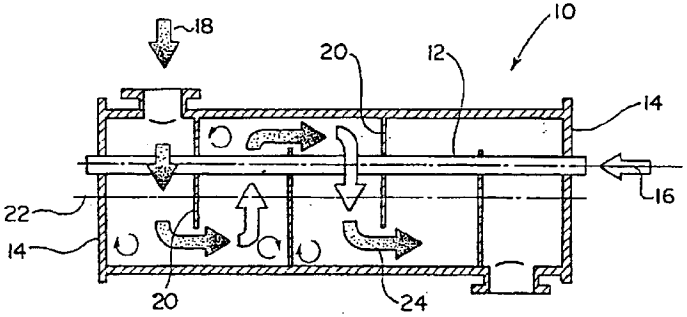
FIG. 1 (Prior Art)
FIG. 1 is a diagrammatic view of flow distribution in a conventional shell and tube heat exchanger.

Referring to FIG. 2, the inventive helically baffled heat exchanger 30 is configured with a plurality of quadrant shaped segment baffle plates 32 each positioned at an angle λ relative to a normal N-N to a longitudinal axis A-A of a shell 34. The baffle quadrant plates 32, (hereafter referred to as baffles), thus guide a shellside cross flow 36 into a helical pattern and at a reduced unsupported pipe spans between the baffles. The result is true cross flow on shellside with effective conversion of available pressure drop to heat transfer and reduced risk due to minimized vibration of pipes 40 traversed by another fluid. There are no dead spots along the cross flow 36 for fouling, and wasted energy of eddies or back mixing is substantially eliminated. Although the baffles 32, as shown in the accompanying drawings, are flat, the opposite sides of each baffle may be curved to guide the cross flow 36 along the helical pattern.

Figure 3:
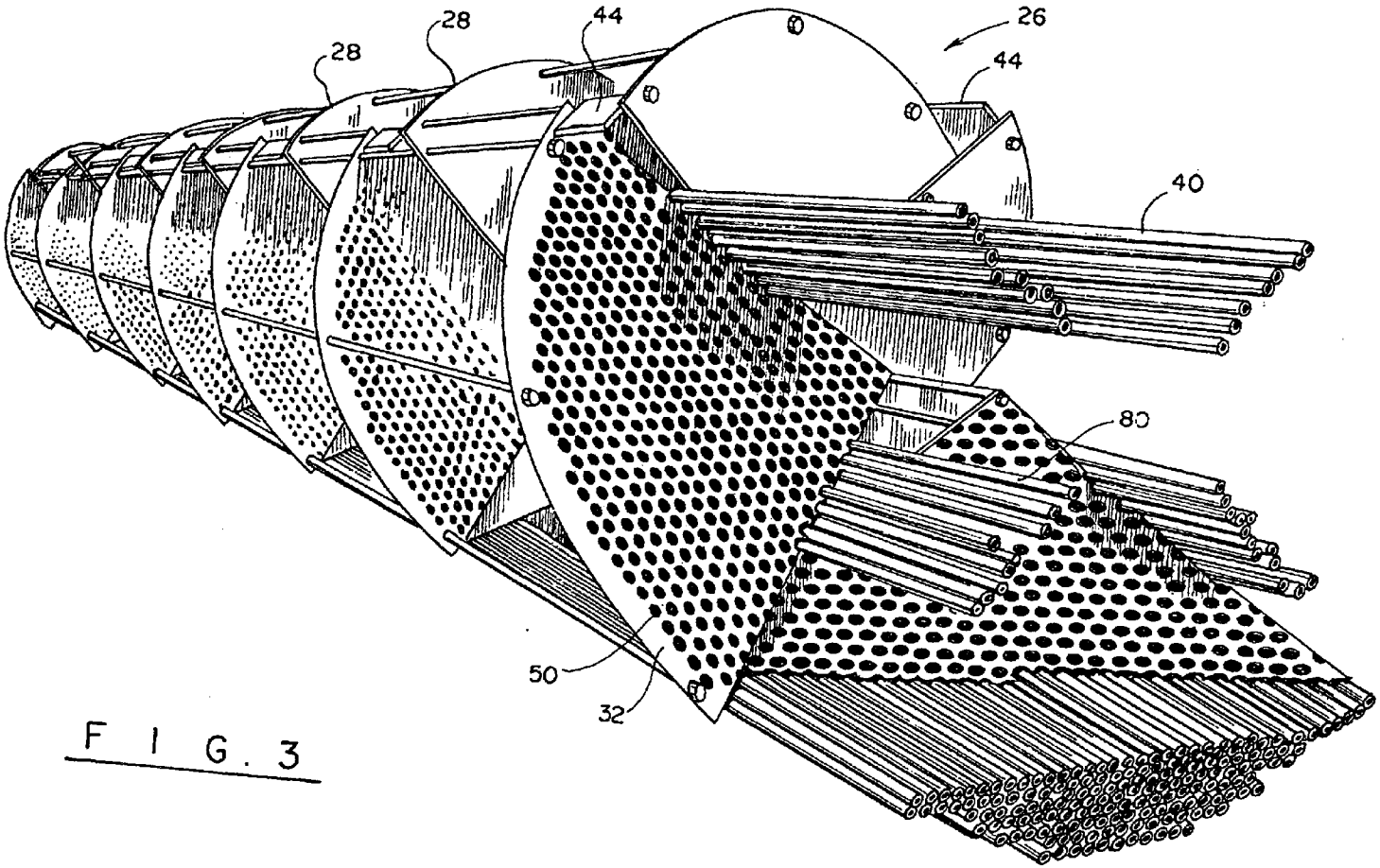
FIG. 3 is a perspective view of a baffle cage.
Figure 4:
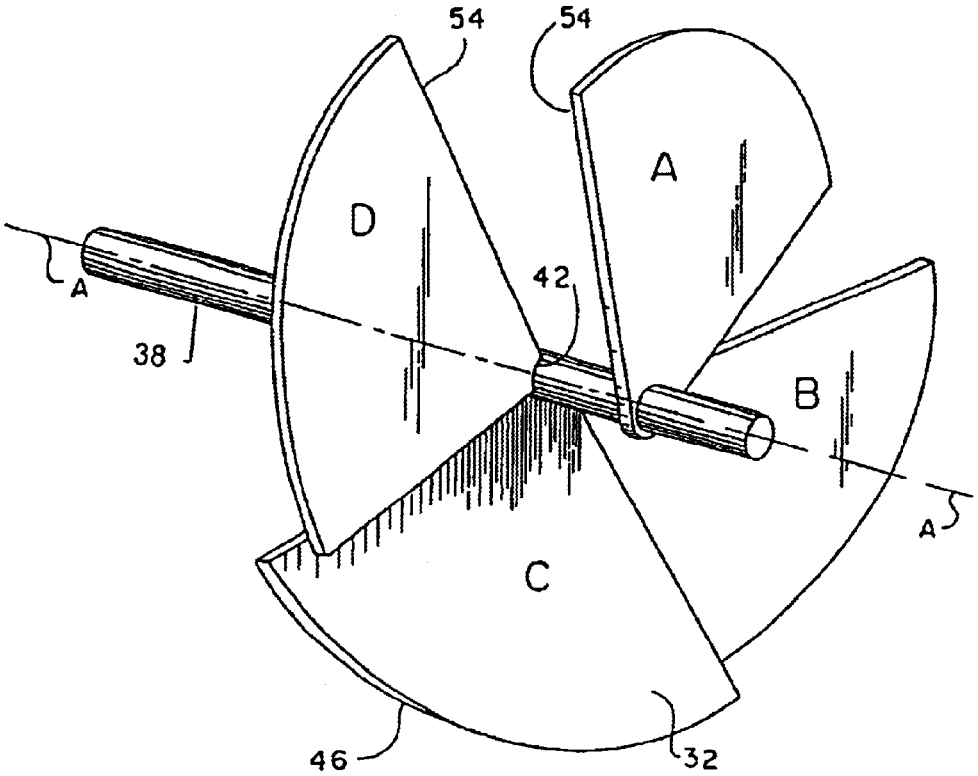
FIG. 4 is an elevational isometric view of a four-quadrant baffle assembly.

As illustrated in FIGS. 3 and 4, a baffle cage 26, which is a combination of successive baffles or quadrant plates 32 positioned at the angle λ and interconnected by a plurality of tie rods 28, serves as a support for multiple pipes 40 and as a helical guide for the cross flow 36. Preferably, the cage has a center pipe 38 (FIG. 4) supporting each of the baffles in a respective desired angular position characterized by alignment between holes 50 of successive baffles 32, which is necessary for efficient installment of a plurality of pipes 40 within the shell. To ensure the proper angular position of the baffles 32 and, thus, the structural accuracy of the cage 26, an apex of each baffle may be drilled with a uniquely angled notch 42 formed so that the baffles 32 maintain the angle λ while being displaced along the center pipe 38.

Figure 6:
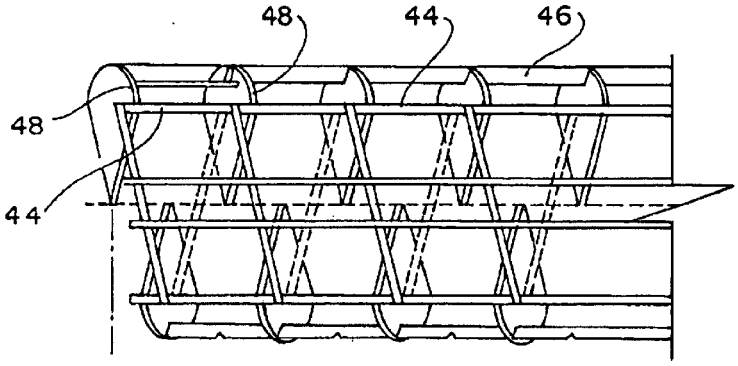
FIG. 6 is an elevational side view of the inventive heat exchange of FIG. 2 illustrating longitudinal seal strips.

In accordance with a further embodiment of the invention, installing longitudinal seal strips 44 between the baffles 32, as illustrated in FIGS. 3 and 6, further enhances the accuracy of the cage 26. The geometry of the baffles 32 is configured to have corner tips 48 of peripheral edges 46 of the baffles 32 oppose to one another. If the baffles are remained unsupported then minimal structural irregularities and flow loads may cause misalignment of pipe holes 50 of the successive baffles. Bridging these unsupported end regions 48 with seal strips 44, each coupling a respective row of parallel baffles, improves alignment between pipe holes 50, and, upon the securement of the desired position of the baffles, allows for an efficient installation of the pipes 40.

The seal strips 44 provide a simple, efficient and cost-effective structure ensuring the proper position of the adjacent baffles and reliable securement of the pipes common to these baffles. Advantageously, the seal strips 44 are positioned within the clearance between the outer edges 46 (FIGS. 4, 5) of the baffles and the inside of the shell to avoid interference with the cross flow and may be variously shaped including a polygonal or annular shape. Each of the seal strips 44 continuously extends along the entire length of the cage 26 and is spot-welded or tack welded to the corer tips 48.

Figure 7:
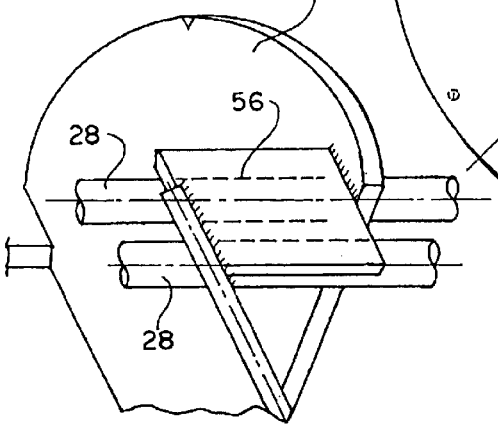
FIG. 7 is an elevational view of the inventive heat exchanger illustrating stiffener strips.
Figure 9:
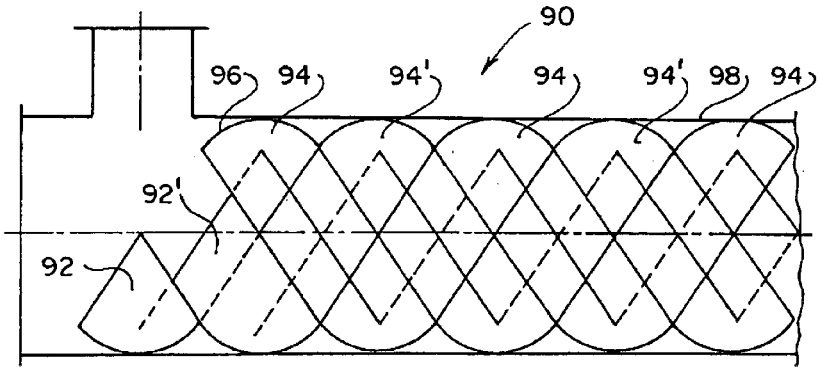
FIG. 9 is a schematic view of a double helix configuration of the inventive helical quadrant baffle arrangement.

In accordance with an embodiment shown in FIG. 7, the desired clearance between the adjacent baffles can be achieved by providing spacer strips or stiffening plates 56 across the tie rods 28, each of which is attached to a respective one of the adjacent baffles 32, as better seen in FIG. 3. This reinforcing arrangement has partially the same rational as the embodiment disclosed immediately above and allows the desired alignment between the pipe holes 50 of the baffles 32. A further advantage stemming from the installation of stiffener plates 56 allows for reliable engagement of the pipes 80 common to the adjacent baffles 32 (FIG. 3 and 9). Semi-circular notches 52 (FIGS. 4, 5) formed along flanks 54 of the adjacent baffles engage the common pipes 80 from opposite sides. Having been reinforced by the plates 56, the baffles 32 are stiffened angularly towards one another so that the notches 52 formed on the adjacent baffles securely engage the pipes 80 therebetween.

Figure 8:
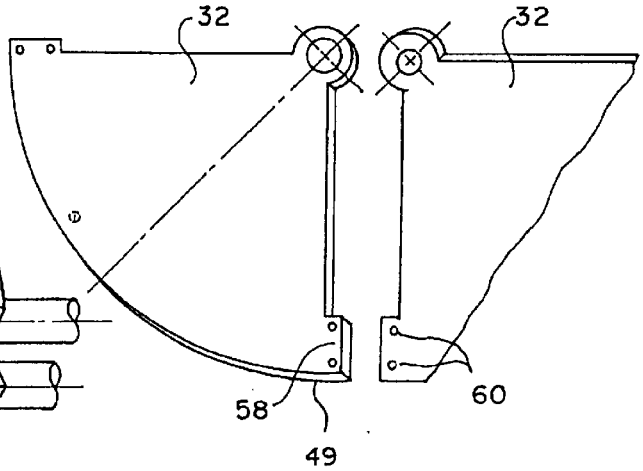
FIG. 8 is an elevational view of the inventive quadrant baffles configured in accordance with another embodiment of the invention.

In accordance with still a further alternative embodiment of the inventive reinforcing element, the end regions 49 of the adjacent baffles 32 can be braced by a common pipe row or rows, as shown in FIG. 8. Specifically, the end region 49 of the baffle 32 is formed as an overhang or extending section 58 having at least one aperture 60. Overlapped sections 58 of the adjacent baffles are so positioned that the apertures 60 are aligned relative to one another and traversed by the pipe(s) 50. This embodiment is particularly advantageous since there is no need for additional reinforcing elements to align the adjacent baffles, which, if used as shown in FIGS. 6 and 7, increase the manufacturing, installment and maintenance costs.

Figure 5:
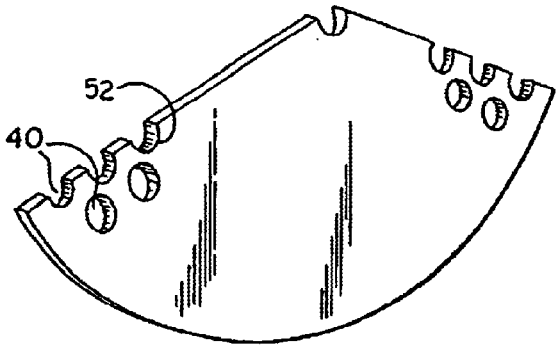
FIG. 5 is a view of a single baffle configured in accordance with the invention.

Complying with the structural particularities of the shell and tube configuration heat exchanger, each baffle 32 terminates at a radial distance from an inside wall 62 of the shell 34 (FIG. 2). Conventionally, a baffle plate has a peripheral edge conforming to a circular arch of the shell. Positioning the circular baffles at the angle $\lambda$ would necessarily provide a non-uniform clearance between the circular inside wall 62 of the shell and the outer peripheral edge of the baffle, if the latter was shaped complementary to the inside wall 62. Hence, the velocity of the cross flow through the non-uniform clearance would be non-uniform as well. To remedy it, the inventive baffles 32, as shown in FIGS. 2, 4 and 5, each have the outer peripheral edge 46 shaped as a segment of the elliptical surface, which, when the baffles 32 are positioned at the angle $\lambda$, are uniformly spaced from the inside wall 62 of the shell.

FIG. 9 illustrates a double helix baffle arrangement 90 configured in accordance with the invention. Increasing the frequency of the baffles 32, a non-supported span of the pipes 40 (FIG. 3) is reduced in half, without, however, affecting the velocity of the cross flow, which remains substantially uniform.

Increasing the frequency of the baffles 32 poses a problem of positioning the adjacent baffles in the cage 26 because of the space deficit. As shown in FIGS. 4 and 9, baffles 94 and 94' of first helix 96 and second helix 98, respectively, each have a hole 100 drilled at the desired angle $\lambda$ and dimensioned to surround and slide along the central pipe 38 (FIG. 4). Accordingly, rotating these baffles about the central pipe 38 allows for their desired angular positions and, when the position is established, diametrically opposite baffles 92' and 92, each formed with a notched apex 42 (FIG. 4), can be easily shifted along the central pipe 38 to avoid the interference with the apexes of baffles 94 and 94'.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. A heat exchanger comprising:

a shell having a longitudinal axis and configured to receive a first fluid; and a plurality of quadrant-shaped baffles each mounted in the shell at an angle to the longitudinal axis to guide a first fluid flow into a helical pattern though the shell at a substantially uniform velocity, each said baffle having an apex longitudinally spaced apart from the apex positions of all other baffles.

2. The heat exchanger of claim 1, wherein the angle differs from a right angle.

3. The heat exchanger of claim 1, wherein the quadrant-shaped baffles each have a respective pair of opposite sides configured to be flat or curved and a plurality of spaced apart holes configured to be traversed by a plurality of axially extending pipes carrying a second fluid in a desired position of the quadrant-shaped baffles.

4. The heat exchanger of claim 3, wherein the opposite sides of each quadrant-shaped baffle define therebetween an elliptical outer edge facing an inside of the shell and spaced therefrom at a uniform radial distance, whereas the first fluid generates a substantially uniform pressure along opposite sides of each quadrant-shaped baffle as the first fluid flows between the elliptical outer edge of the quadrant-shaped baffles and the inside of the shell at a substantially uniform velocity.

5. The heat exchanger of claim 4, further comprising a plurality of angularly spaced apart seal strips extending parallel to the longitudinal axis of the shell, each of the seal strips bridging the outer edges of the quadrant-shaped baffles to secure the desired position thereof, in which the holes of adjacent quadrant-shaped baffles are aligned, and to minimize vibration produced by the pipes exposed to the first flow fluid.

6. The heat exchanger of claim 5, wherein each of the seal strips is a continuous rod having a polygonal or annular cross-section and fixed to end regions of the outer edges of the successive quadrant-shaped baffles positioned parallel to one another in a row.

7. The heat exchanger of claim 4, further comprising a plurality of longitudinally extending tie rods each penetrating through end regions of the outer edges of a respective row of parallel quadrant-shaped baffles, and a plurality of stiffener strips coupling adjacent tie rods between the end regions of adjacent quadrant-shaped baffles to secure the desired position of the quadrant-shaped baffles and to reduce vibration.

8. The heat exchange of claim 7, wherein the stiffener strips each are a plate fixed atop the coupled tie rods.

9. The heat exchanger of claim 7, wherein the opposite sides of each quadrant-shaped baffle define therebetween a pair of flanks each formed with a row of semi-holes, wherein the semi-holes of adjacent quadrant-shaped baffles are positioned to engage the pipes common to the adjacent quadrant-shaped baffles in the desired position thereof.

10. The heat exchanger of claim 4, wherein each of the quadrant-shaped baffles has a pair of flanks converging toward one another from a respective outer edge, which has spaced apart extending end portions each overhanging a respective one of the pair of flanks and configured to overlap the extending portion of an adjacent quadrant-shaped baffle in the desired position of the quadrant-shaped baffles.

11. The heat exchanger of claim 10, wherein the extending end portions each are provided with at least one of the plurality of holes aligned with a respective hole of the extending portion of the adjacent quadrant-shaped baffle in the desired position of the quadrant-shaped baffles, wherein as the holes formed in the extending portions of the adjacent baffles are traversed by a respective pipe to secure the desired position of the quadrant-shaped baffles.

12. The heat exchanger of claim 4, wherein the plurality of quadrant-shaped baffles mounted at the angle to the longitudinal axis to define the first helical pattern of the first fluid flow each has a respective pair of flanks converging from the outer edge and forming an apex, which is terminated on the longitudinal axis of the shell.

13. The heat exchanger of claim 12, wherein each of the apexes of the quadrant-shaped baffles has a respective notch shaped to conform to an outer surface of a central pipe centered along the longitudinal axis of the shell.

14. The heat exchanger of claim 12, further comprising another plurality of quadrant-shaped baffles mounted in the shell at the angle to guide the first fluid flow into the helical pattern, wherein the heat exchanger is provided with a double helix configuration reducing unsupported spans of the pipes between successive quadrant-shaped baffles while maintaining the uniform velocity of the first fluid flow.

15. The heat exchanger of claim 14, wherein at least a portion of the other plurality of quadrant-shaped baffles each has a respective apex provided with a respective hole traversed by the central pipe and configured so that the quadrant-shaped baffle is rotatable about a central pipe, centered about the longitudinal axis, to the desired position.

16. A shell and tube type heat exchanger comprising a series of quadrant shaped baffles supporting a bundle of second fluid carrying pipes oriented in a direction transverse to the baffles, said baffles being configured to guide a first fluid along a helical path across the bundle of pipes, and means for reinforcing the baffles, wherein the series of quadrant-shaped baffles form a partial barrier to the first fluid and each baffle has an outer elliptical edge for establishing a uniform flow velocity of the first fluid through clearances provided between the elliptical edges and an inside surface of the shell.

17. The shell and tube type heat exchanger of claim 16, wherein the quadrant shaped baffles each include an elliptical outer edge and the means for reinforcing is configured to couple the outer elliptical outer edges of at least two adjacent quadrant-shaped baffles.

18. A shell and tube type heat exchanger extending along a longitudinal axis, comprising a first string of quadrant-shaped baffles and a second string of quadrant-shaped baffles forming a double-helix arrangement traversed by a bundle of second fluid carrying pipes and positioned at an angle to the longitudinal axis to guide a first fluid into a helical pattern at a substantially uniform velocity, wherein each of the quadrant-shaped baffles has an outer elliptical peripheral edge and two flanks converging from the elliptical peripheral edge toward one another to form an apex provided with an angularly drilled hole to allow angular positioning of each of the quadrant-shaped baffles with respect to the longitudinal axis in a desired sequential manner prior to securing the first and second strings of quadrant-shaped baffles relative to one another.

* * * * *

US006827138C1

(12) EX PARTE REEXAMINATION CERTIFICATE (7679th)

United States Patent

Master et al.

(10) Number: US 6,827,138 C1

(45) Certificate Issued: Aug. 10, 2010

(54) HEAT EXCHANGER

(75) Inventors: Bashir I. Master, Wayne, NJ (US); Krishnan S. Chunangad, West Paterson, NJ (US); Venkateswaran Pushpanathan, West Paterson, NJ (US)

(73) Assignee: D, Glenn Vicari, ABB Lummus Global, Bloomfield, NJ (US)

Reexamination Request:
No. 90/010,219, Jul. 10, 2008

Reexamination Certificate for:

| | |
|---|---|
| Patent No.: | **6,827,138** |
| Issued: | **Dec. 7, 2004** |
| Appl. No.: | **10/644,157** |
| Filed: | **Aug. 20, 2003** |

(51) Int. Cl.

| | |
|---|---|
| ***F28F 9/22*** | (2006.01) |
| ***F28D 7/16*** | (2006.01) |
| ***F28D 7/00*** | (2006.01) |

(52) U.S. Cl. ..... 165/159; 165/162

(58) Field of Classification Search ..... 165/158–162
See application file for complete search history.

(56) References Cited

U.S. PATENT DOCUMENTS 3,656,548 A * 4/1972 Donaldson ..... 165/159

FOREIGN PATENT DOCUMENTS

CS 209 126 11/1981

OTHER PUBLICATIONS

Incropera and DeWitt. Fundamentals of Heat and Mass Transfer, 3rd. ed. NY, John Wiley & Sons, 1990. pp. 641 and 642.*

Quadrant. (2007). In The Penguin English Dictionary. London: Penguin. Retrieved Mar. 24, 2009, from http://www.credoreference.com/entry/8496857/.*

Quadrant. (1996). In Webster's Third New International Dictionary, Unabridged. Retrieved Mar. 24, 2009, from http://lionreference.chadwyck.com.*

Bayazitoğlu, Y. and Özisik, M. Elements of Heat Transfer. NY, McGraw–Hill, 1988. p. 370.*

Blumenthal, Leonard M. "Ellipse" in AccessScience@McGraw–Hill. Retrieved Mar. 26, 2009 from http://www.accessscience.com, DOI 10.1036/1097–8542.228700.*

ABB Lummus Helixchanger advertisement. Heat Transfer Engineering. May–Jun. 2002. p. 42, vol. 23, No. 3. Talyor & Francis Ltd., London, UK.*

Wang, S. "Hydrodynamic Studies on Heat Exchnagers with Helical Baffles", Heat Transfer Engineering. May–Jun. 2002. pp. 43–49, vol. 23, No. 3, Talyor & Francis Ltd., London, UK.*

Kral et al., "Helical Baffles in Shell–and–Tube Heat Exchangers, Part I: Experimental Verification," Heat Transfer Engineering, 1996, pp. 93–101, vol. 17, No. 1, Taylor & Francis.

Stehlik et al., "Comparison of Correction Factors for Shell–and–Tube Heat Exchangers with Segmental or Helical Baffles," Heat Transfer Engineering, Jan.–Mar. 1994, pp. 55–65, vol. 15, No. 1, Taylor & Francis Ltd., London, UK.

Knudsen et al., "Investigation of a Novel Helical Flow Shell and Tube Heat Exhanger," Heat Transfer 1998, Proceedings of the Eleventh International Heat Transfer Conference, 1998, pp. 293–298, The Korean Society of Mechanical Engineers, Seoul, Korea.

Kuppan, Heat Exchanger Design Handbook, 2000, p. 264, Marcel Dekker, Inc., USA.

* cited by examiner

*Primary Examiner*—Sara S Clarke

(57) ABSTRACT

A heat exchanger is configured to have quadrant shaped baffles positioned at an angle to a longitudinal axis of shell for guiding cross-flow of fluid into a helical pattern while maintaining substantially uniform velocity of the cross-flow.

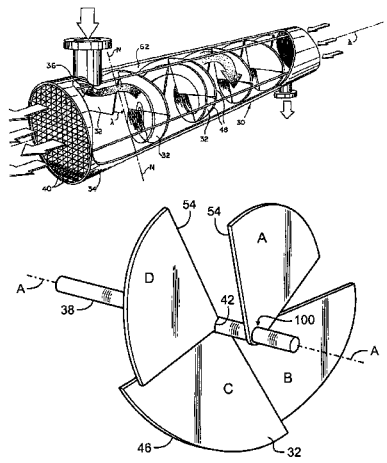

(amended)

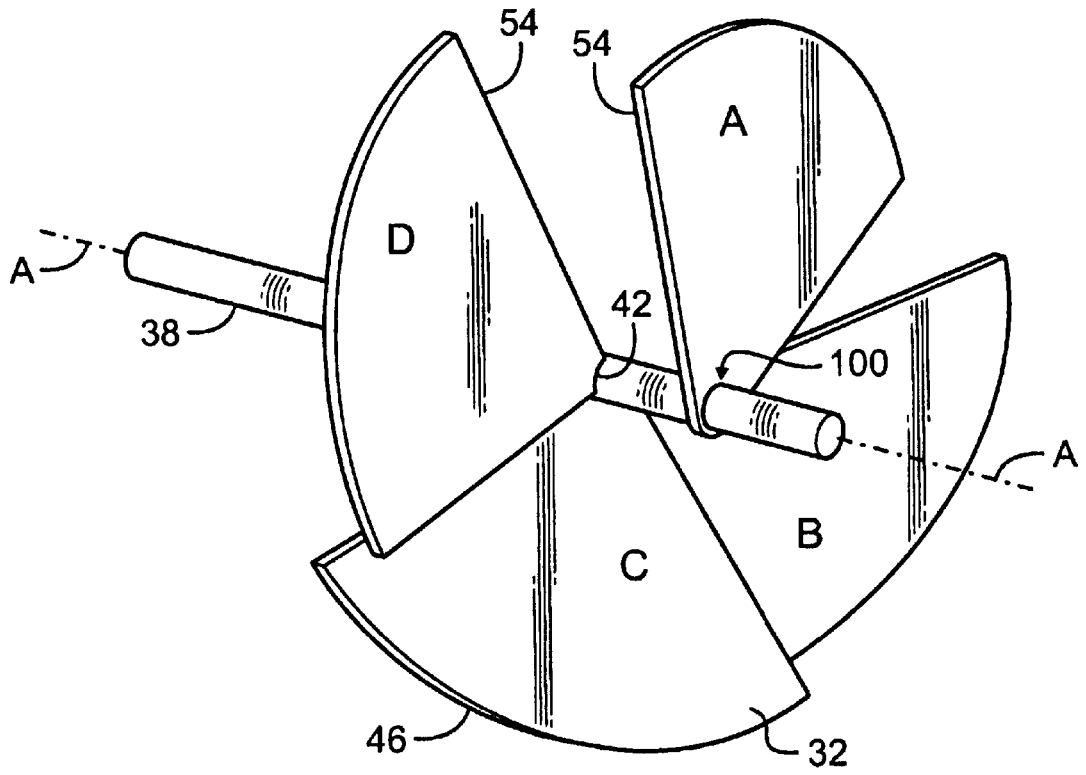
FIG. 4
(amended)
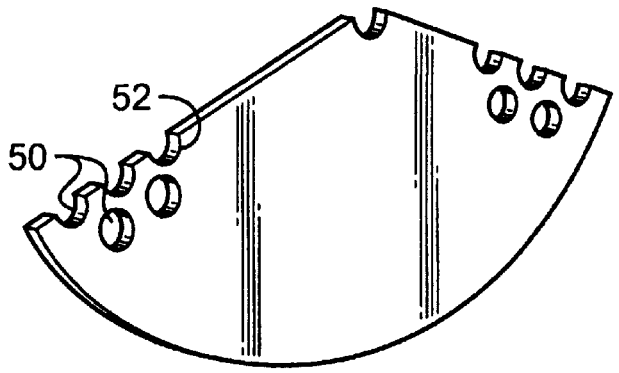
FIG. 5
(amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 16-28:

In accordance with still a further alternative embodiment of the inventive reinforcing element, the end region 49 of the adjacent baffles 32 can be braced by a common pipe row or rows, as shown in FIG. 8. Specifically, the end region 49 of the baffle 32 is formed as an overhang or extending section 58 having at least one aperture 60. Overlapped sections 58 of the adjacent baffles are so positioned that the apertures 60 are aligned relative to one another and traversed by the pipe(s) [50] *40*. This embodiment is particularly advantageous since there is no need for additional reinforcing elements to align the adjacent baffles, which, if used as shown in FIGS. 6 and 7, increase the manufacturing, installment and maintenance costs.

THE DRAWING FIGURES HAVE BEEN CHANGED AS FOLLOWS:

In FIG. 4, reference character 100 with corresponding lead line and arrow were added. In FIG. 5, reference character 40 has been changed to 50.

AS A RESULT OF REEXAMINATION, IT HAS BEEN DETERMINED THAT:

The patentability of claims 16-18 is confirmed.

Claim 3 is cancelled.

Claims 1, 4, 5, 7, 10 and 12 are determined to be patentable as amended.

Claims 2, 6, 8, 9, 11, and 13-15 dependent on an amended claim, are determined to be patentable.

1. A heat exchanger comprising:

a shell having a longitudinal axis and configured to receive a first fluid; and a plurality of quadrant-shaped baffles each mounted in the shell at an angle to the longitudinal axis to guide a first fluid flow into a helical pattern through the shell at a substantially uniform velocity, each said baffle having an apex longitudinally spaced apart from the apex positions of all other baffles;

*wherein the quadrant-shaped baffles each have a respective pair of opposite sides configured to be flat or curved and a plurality of spaced apart holes configured to be traversed by a plurality of axially extending pipes carrying a second fluid in a desired position of the quadrant-shaped baffles; and*

*wherein the opposite sides of each quadrant-shaped baffle define therebetween an elliptical outer edge facing an inside of the shell and spaced therefrom at a uniform radial distance.*

4. The heat exchanger of [claim 3] *claim 1*, wherein [the opposite sides of each quadrant-shaped baffle define therebetween an elliptical outer edge facing an inside of the shell and spaced therefrom at a uniform radial distance, whereas] the first fluid generates a substantially uniform pressure along opposite sides of each quadrant-shaped baffle as the first fluid flows between the elliptical outer edge of the quadrant-shaped baffles and the inside of the shell at a substantially uniform velocity.

5. The heat exchanger of [claim 4] *claim 1*, further comprising a plurality of angularly spaced apart seal strips extending parallel to the longitudinal axis of the shell, each of the seal strips bridging the outer edges of the quadrant-shaped baffles [to secure] *and securing* the desired position thereof, in which the holes of adjacent quadrant-shaped baffles are aligned, and to minimize vibration produced by the pipes exposed to the first fluid flow.

7. The heat exchanger of [claim 4] *claim 1*, further comprising a plurality of longitudinally extending tie rods each penetrating through end regions of the outer edges of a respective row of parallel quadrant-shaped baffles, and a plurality of stiffener strips coupling adjacent tie rods between the end regions of adjacent quadrant-shaped baffles to secure the desired position of the quadrant-shaped baffles and to reduce vibration.

10. The heat exchanger of [claim 4] *claim 1*, wherein each of the quadrant-shaped baffles has a pair of flanks converging toward one another from a respective outer edge, which has spaced apart extending end portions each overhanging a respective one of the pair of flanks and configured to overlap the extending portion of an adjacent quadrant-shaped baffle in the desired position of the quadrant-shaped baffles.

12. The heat exchanger of [claim 4] *claim 1*, wherein the plurality of quadrant-shaped baffles mounted at the angle to the longitudinal axis to define the first helical pattern of the first fluid flow each has a respective pair of flanks converging from the outer edge and forming an apex, which is terminated on the longitudinal axis of the shell.

* * * * *